US006959973B2

(12) United States Patent
Kubota

(10) Patent No.: US 6,959,973 B2
(45) Date of Patent: Nov. 1, 2005

(54) INK JET PRINTING APPARATUS AND INK JET PRINTING METHOD USING SELECTIVE APPLICATION OF DIFFERENT VOLTAGES TO CONTROL INK DISCHARGE

(75) Inventor: Hidemi Kubota, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 39 days.

(21) Appl. No.: 10/622,541

(22) Filed: Jul. 21, 2003

(65) Prior Publication Data

US 2004/0017435 A1 Jan. 29, 2004

(30) Foreign Application Priority Data

Jul. 23, 2002 (JP) ..... 2002-214516
Jul. 23, 2002 (JP) ..... 2002-214517

(51) Int. Cl.[7] ..... B41J 29/38
(52) U.S. Cl. ..... 347/13; 347/57

(58) Field of Search ..... 347/9–14, 61, 347/63, 65, 67, 56–59, 5, 40, 42; 400/120.12, 120

(56) References Cited

U.S. PATENT DOCUMENTS 5,172,134 A * 12/1992 Kishida et al. ..... 347/13

* cited by examiner

*Primary Examiner*—Juanita D. Stephens
(74) *Attorney, Agent, or Firm*—Fitzpatrick, Cella, Harper & Scinto

(57) ABSTRACT

A printing apparatus employing a bubble jet (a registered trademark) capable of maintaining at all times conditions of ink at and around a discharge port suitable for discharge without performing a predischarge or the like involving an interruption of a printing operation is provided. The printing apparatus supplies the electrothermal energy converting element with such an electrical energy that generates a bubble to the extent that ink droplets are discharged from the nozzle.

11 Claims, 9 Drawing Sheets

INK JET PRINTING APPARATUS AND INK JET PRINTING METHOD USING SELECTIVE APPLICATION OF DIFFERENT VOLTAGES TO CONTROL INK DISCHARGE

This application claims priority from Japanese Patent Application Nos. 2002-214516 filed Jul. 23, 2002 and 2002-214517 filed Jul. 23, 2002, which are incorporated hereinto by reference.

BACKGROUND OF THE INVENTION

1. Field of the Invention

The present invention relates to a printing apparatus used for a printer or a copying machine, and more specifically, an ink jet printing apparatus and an ink jet printing method using an ink jet printing head.

2. Description of the Related Art

Two broad categories of the ink jet printing apparatus discharging ink from a printing head are available according to the type of means of generating energy for discharging ink, provided at the printing head. Specifically, they are one using an electromechanical energy converting element, such as a piezo, and one using an electrothermal energy converting element, such as a heater. Of these different types, an ink jet printing head using thermal energy generated by the electrothermal energy converting element to discharge ink allows ink discharge ports (nozzles) for discharging printing ink droplets (ink droplets) to be highly densely laid out. This design feature makes possible not only printing of high resolution, but also a more compact body and lower cost. Hence, the application in printing apparatuses of various types whether they are for business use or home use.

If the ink jet printing apparatus is left to stand for an extended period of time without discharging ink, however, ink at and around the discharge ports condenses and becomes more viscous due to evaporation of water content of the ink, which makes the ink tend not to be discharged easily. This results in a discharge velocity at the printing head being reduced and a discharge direction becoming disordered. In extreme cases, the printing head may become completely unable to discharge ink.

The ink jet printing apparatus currently put into practical use is therefore provided with a cap that covers the discharge ports in a totally closed condition during times of nonprinting. The cap is also used for performing a suction recovery operation in which the negative pressure slightly sucks the ink to drain out at and around the discharge ports, by applying a negative pressure from a negative pressure source that communicates with the cap into the cap that totally closes the discharge ports immediately before recording etc. Thereby refreshing the ink at and around the discharge ports and maintaining the ink in a condition suitable for discharge.

This suction recovery operation can be executed only while a printing operation is not performed. The ink at and around the discharge ports can, however, condense and become more viscous even while a printing operation is performed. In such a case, the aforementioned problems can occur. It goes without saying that the ink does not condense or become more viscous, as long as it is discharged from each of the discharge ports at all times when the cap is open. The ink is not, however, discharged from all of the discharge ports during the printing operation. Rather, there can be a discharge port or ports, from which ink is not discharged at all even during a period of printing operation depending on the type of image being handled.

As described in the foregoing, the ink may not be discharged properly due to condensation and thickening of ink at and around the discharge ports, resulting in a printing problem, even when a printing command is issued to a nozzle, from which discharge has not been done for an extended period of time. Degradation of image quality arising from a printing problem as described in the foregoing becomes particularly conspicuous, if a portion of an image to be formed is an edge portion or a fine line portion of a figure.

The conventional ink jet printing apparatus is provided with even another arrangement based on the assumption that there will arise a difference in frequency of use among different nozzles during the printing operation as noted in the foregoing. Specifically, referring to FIG. 9, the printing head is moved to a discharge mechanism 5 provided at a position P2 beyond a scanning area involved with the printing operation (ordinary scanning area) E. Each of the nozzles of the printing head is then subjected to a discharge discharge operation of ink not contributing to the printing operation (predischarge), thereby preventing the problem of nondischarge or the like from occurring. Performing the predischarge to recording, such as this one, during the printing operation period, however, leads to an increase in the printing time and ink consumption.

With the trend in the image produced by the recent ink jet printing apparatuses becoming higher and higher definition, the size of each nozzle used in the printing head is becoming more and more miniaturized. With this miniaturized nozzle, the value of (opening area of discharge port)/(volume) increases. As a result, the ink at and around the discharge ports tend to condense at an even more rapid pace due to evaporation of water content of the ink from the discharge ports. The effect of thickening of the ink from condensation greatly affects discharge processes, resulting in an error being produced in a position an ink droplet lands at or nondischarge tending to occur. To keep the ink at the nozzle having a low use frequency in good conditions, therefore, it becomes necessary to frequently move the printing head to the predischarge position. This results in the printing time increasing and the printing speed decreasing.

A detailed study was conducted using ink, or a mixture of dyes, water, and other solvents, packed in a thin nozzle. The fact that a simple thickening of ink occurs from condensation involved with evaporation of water content of the ink from the discharge ports has been confirmed in this study. In addition to this fact, it has also been found that the exposure to air of a surface part of the ink forms a structure, as a result of dyes and other components gathering on a surface layer within a certain range of time period. The structure formed on the surface layer (hereinafter referred to as the ink structure) has a certain dynamic strength, producing a serious adverse effect on flying of ink droplets.

It is nonetheless possible to easily destroy the ink structure formed at and around the discharge ports by increasing the area of the surface portion of the ink at and around the discharge ports. The principle applicable to this phenomenon is based on the principle that is applicable to breaking thin ice on the surface of water by rippling the water. Namely, enlarging the area of the surface portion of the ink causes cracks to occur in (and thus destroys) the ink structure formed at and around the surface of the discharge ports. This, in turn, allows the dynamic strength of the ink structure to be reduced to the extent that the dynamic strength of the ink structure does not affect flying of ink. Once the ink structure is destroyed, it is possible to fly the ink properly for some time from immediately thereafter until a new ink structure is produced. That is, it is possible to extend the time before the discharge problem occurs by simply oscillating the surface of the ink structure so as to increase the area thereof without having to discharging ink.

Means of removing the ink structure formed at and around the surface of the nozzle discharge ports without involving discharge of ink, as that described in the foregoing, are proposed in a number of patent publications as applicable to printing apparatuses employing the piezo printing system mentioned earlier. These publications include Japanese Patent Application Laid-open No. 53-105321(1978), Japanese Patent Application Laid-open No. 55-042809(1980), Japanese Patent Application Laid-open No. 59-164151 (1984), Japanese Patent Application Laid-open No. 03-164258(1991), Japanese Patent Application Laid-open No. 07-178907 (1995), Japanese Patent Application Laid-open No. 09-201960 (1997), and Japanese Patent Application Laid-open No. 09-226116(1997).

In what is called a bubble jet (a registered trademark) method that makes use of the pressure of bubbles formed through boiling of ink, however, a dynamic change can be made in the ink only when bubbles are formed. Further, once bubbles are formed, the pressure involved in forming the bubbles causes the ink to be invariably discharged.

For this reason, with the conventional ink jet printing apparatus using what is called the bubble jet method, it has been considered to be extremely difficult and impractical to destroy the ink structure formed at and around the surface of the discharge ports by oscillating the ink to the extent only that the oscillation does not allow the ink to be discharged.

SUMMARY OF THE INVENTION

It has been desired to provide an ink jet printing apparatus and an ink jet printing method capable of maintaining, at all times, a condition of ink formed at and around discharge ports suitable for discharge without performing a predischarge that involves an interruption of a printing operation and capable of continued printing operation.

Therefore, the following arrangements are provided according to preferred embodiments of the present invention.

Specifically, according to a first aspect of the present invention provides an ink jet printing apparatus capable of mounting a printing head having a plurality of ink discharging ports for discharging ink, electrothermal energy converting elemens provided corresponding to each of the plurality of ink discharging ports being energized by energization means of a predetermined type to cause heating and a resultant thermal energy thus generated then being used to generate bubbles in ink in each of the ink discharging ports and pressure generated by the bubbles then making ink droplets fly from each of the ink discharging ports to accomplish printing; the energization means, comprising: a single driving power source serving as a source of supplying the electrical energy; and a control unit for controlling the electrical energy supplied from the driving power source; wherein the control unit performs a control for supplying the electrothermal energy converting element with such an electrical energy that generates bubbles to the extent that ink droplets are discharged from the ink discharging ports, if the electrothermal energy converting element is driven to accomplish printing; wherein the control unit performs a control for supplying the electrothermal energy converting element with such an electrical energy that generates bubbles to the extent that ink droplets are not discharged from the ink discharging ports; and wherein the controls are selectively performed.

According to a second aspect of the present invention provides an ink jet printing method using a printing head having a plurality of ink discharging ports for discharging ink, electrothermal energy converting elements provided corresponding to each of the plurality of ink discharging ports being energized and then generating a bubble in the ink to discharge ink; comprising the steps of: first step for supplying the electrothermal energy converting element with such an electrical energy that generates bubbles to the extent that ink droplets are discharged from the ink discharging ports, if the electrothermal energy converting element is driven to accomplish recording; and second step for supplying the electrothermal energy converting element with such an electrical energy that generates bubbles to the extent that ink droplets are not discharged from the ink discharging ports; wherein the first step and second step are selectively performed.

According to a third aspect of the present invention provides an ink jet printing apparatus capable of mounting a printing head having a plurality of ink discharging ports for discharging ink, electrothermal energy converting elemens provided corresponding to each of the plurality of ink discharging ports being energized by energization means of a predetermined type to cause heating and a resultant thermal energy thus generated then being used to generate bubbles in ink in each of the ink discharging ports and pressure generated by the bubbles then making ink droplets fly from each of the ink discharging ports to accomplish printing; wherein the energization means generates driving signals for supplying the electrothermal energy converting elements corresponding to low use frequency ink discharging ports with such an electrical energy that generates bubbles in ink in the low use frequency ink discharging ports to the extent that ink droplets are not discharged from the low use frequency ink discharging ports.

According to a fourth aspect of the present invention provides an ink jet printing method, comprising a printing head forming a plurality of ink discharging ports for discharging ink, each of the plurality of ink discharging ports being provided with an electrothermal energy converting element, the electrothermal energy converting element being energized by energization means of a predetermined type to cause heating and a resultant thermal energy thus generated then being used to generate bubbles in ink in each of the ink discharging ports and pressure generated by the bubbles then making ink droplets fly from each of the ink discharging ports to accomplish printing, wherein the energization means generates driving signals for supplying the electrothermal energy converting elements corresponding to low use frequency nozzles with such an electrical energy that generates bubbles in ink in the low use frequency nozzles to the extent that ink droplets are not discharged from the low use frequency ink discharging ports.

The present invention having the arrangements as described in the foregoing makes possible the following. Specifically, the present invention allows the nozzles that discharge ink droplets frequently to discharge ink droplets properly as unusual. While, the invention suppresses discharge of ink droplets for the ink discharging ports that discharge ink droplets less frequently, while letting bubbles generate for oscillating the ink. The oscillation, in turn, makes it possible to destroy the ink structure formed at and around the discharge port of the ink discharging ports. It is therefore possible to restart a printing operation without having to move the printing head to a recovery position set outside a printing range, even in cases in which a nozzle having less frequency of use is driven or a printing operation is resumed after a pause of the printing operation. This helps enhance efficiency in printing operation.

For the purpose of this specification, the "nozzle" includes a discharge port through which ink is discharged, a liquid passageway communicating with this discharge port, and an electrothermal energy converting element disposed in the liquid passageway.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Preferred embodiments according to the present invention will be described in detail with reference to the accompanying drawings.

The basic principle applicable to the preferred embodiments of the present invention will first be explained.

Many of the currently available ink jet printing apparatuses employ a printing method called the bubble jet (registered trademark) method or thermal jet method. According to this printing method, a miniature electrothermal energy converting element (heater) formed by a thin film is disposed inside a large number of nozzles laid out in a printing head. Current is allowed to pass through this electrothermal energy converting element, or the electrothermal energy converting element is energized, for a brief period of about 10 $\mu$s or shorter. Ink in contact with this electrothermal energy converting element is thereby boiled. A high pressure generated at this time is used to give the ink inside the nozzles an impulse. A momentum is thus given to part of the ink and ink droplets are flown from the discharge port to form a character or an image on a printing medium, such as paper.

Figure 5:
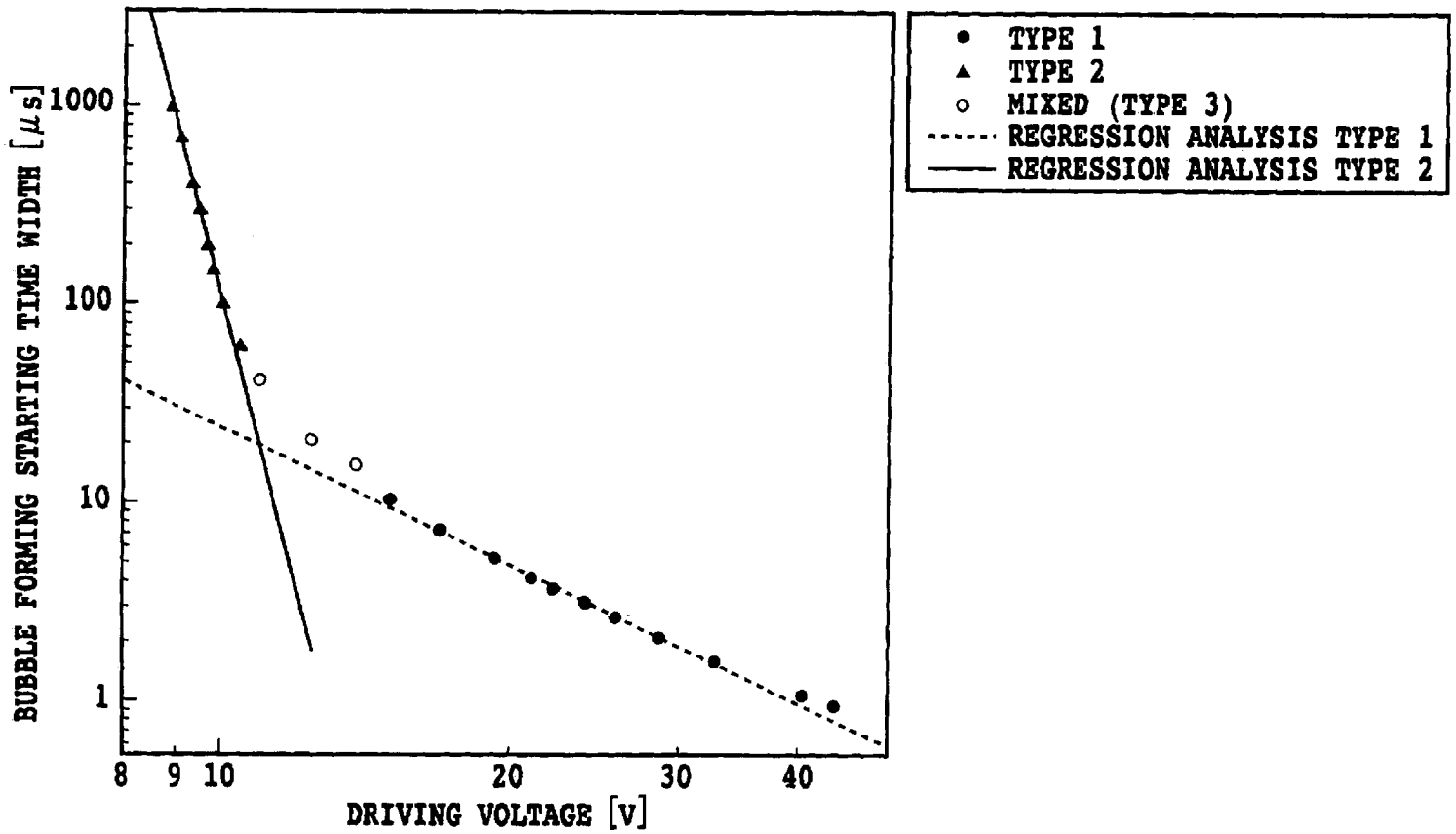
FIG. 5 is an explanatory diagram showing bubble forming characteristics of a printing head in the first embodiment of the ink jet printing apparatus.

FIG. 5 is an explanatory diagram illustrating an example of bubble forming characteristics of a printing head used in what is called a bubble jet printing apparatus incorporating the electrothermal energy converting element. The diagram shows the results of an experiment conducted on the printing head provided in Bubble Jet Printer Model BJC820J manufactured by Canon Inc.

In the experiment, the pulse width of a driving pulse applied to the electrothermal energy converting element was gradually varied with the voltage value of the driving pulse kept constant. The pulse width was then measured when bubble forming started in the ink. The bubble forming condition of the ink was observed using a microscope by illuminating the ink with a strobe light emitted in synchronization with the driving pulse. Data for determining discharge characteristics of the printing head can also be obtained from an experiment conducted by varying the voltage value with the pulse width kept constant.

When the readings taken are plotted on a double logarithmic chart, it reveals two conspicuous characteristics of the printing head. First of all, the following holds true in a portion with relatively high driving voltages in FIG. 5, namely the region plotted with black round dots. Since the voltage is relatively high in this region, a large current flows through the heating element and thus the heat flowing from a surface of the electrothermal energy converting element to ink per unit area and unit time, that is a heat velocity, becomes great. When readings in this region are plotted on a double logarithmic chart as shown in FIG. 5, they are lined up along a straight line.

The gradient of the straight line at this time is substantially −2 on the double logarithmic chart. This condition may be explained as follows. Specifically, the following relation holds true, if a resistance of the electrothermal energy converting element is R, a bubble forming starting time is Pw, a driving voltage is V, and a caloric value of the heating element is W:

$$Pw = R \cdot W \cdot 1/V^2$$

If R and W are constant, then Pw is directly proportional to $1/V^2$. More specifically, if such a relation holds true for the start of bubble forming phenomenon, it is safe to conclude that R does not change so much. This indicates that the heat transferred from the heating element to ink is constant.

This suggests that, in this condition, heat generated by the heating element is not dissipated to a supporting substrate side even with the bubble forming starting time becoming greater as long as the driving voltage remains high. In this condition, therefore, the loaded energy is effectively used and the bubble forming pressure generated in ink is sufficiently high, permitting consistently stable ink discharge. Data in this region become a distribution forming a straight line called type 1 as shown in FIG. 5 as a result of regression analysis.

Examining the region with lower driving voltages of the experimental data shown in FIG. 5 will reveal another characteristic. Experimental data in this region are indicated by black triangles. These data also form a substantially straight line. The gradient of this straight line is, however, far greater than that of the straight line in the region with higher driving voltages described earlier. In this region, the heat flow velocity is relatively small and thus the pressure of bubbles generated is weak. The capacity of discharging ink is therefore small and there are great variations in ink flying velocity. Simply decreasing the driving voltage slightly in this region will make the bubble forming starting time significantly large. Namely, since the driving voltage remains low in this region, current flowing through the heating element is small and heat generated per unit time is therefore small. For this reason, a substantial amount of heat generated from the heating element is transferred to not only the ink, but also the supporting substrate. As a result, it is considered that the relationship between the bubble forming starting time and the driving voltage deviates greatly from the aforementioned pattern that the bubble forming starting time is directly proportional to a reciprocal of a square of the driving voltage.

The data in this region is subjected to a regression analysis, which results in a distribution forming a straight line called type 2 shown in FIG. 5. Three readings indicated by blank round dots at a portion, at which these two types intersect each other, form a transition region. In this transition region, a bubble forming condition having the characteristic of type 1 or type 2 develops as if it were a probability phenomenon for each driving pulse, suggesting that the condition is unstable.

As described in the foregoing, in the printing head working on the bubble jet (registered trademark) method, it is possible to clearly identify two different types of bubble forming conditions as shown in FIG. 5 by plotting the relationship between the bubble forming starting time and driving voltage on a double logarithmic chart.

According to the preferred embodiments of the present invention, ink can be properly flown to accomplish printing, if the electrothermal energy converting element is heated under the driving condition of type 1, of the two broadly isolated conditions of bubble forming characteristics shown in FIG. 5, based on a printing signal. The driving condition of type 2 using the region of longer bubble forming starting times and lower driving voltages is effective when ink thickening has just begun at the discharge port. Specifically, since the ink bubble forming energy is low in the type 2 driving condition, it is not possible to discharge the ink through the discharge ports at which ink has been thickened and only destruction of the structure occurs. It is therefore possible to destroy the ink structure formed at and around the ink discharge ports by executing driving according to type 2, without returning the printing head to a specific location outside a printing area E, such as a recovery portion, during a printing operation effected on a printing medium.

To state it another way, if a bubble forming energy like that described earlier is given to the ink when a pause of even a brief period of time is inserted during the printing operation, ink can be oscillated without discharging ink at and around the discharge ports. This allows the ink structure to be destroyed.

When the type 1 driving method is applied, on the other hand, at which time energy generated during bubble forming is great, ink droplets are discharged from the discharge ports despite inability of proper ink flying due to the presence of the ink structure. The ink droplets then land at improper positions on the printing medium, resulting in an image problem of a chaotic image occurring. To perform a recovery operation, such as the predischarge, therefore, it is necessary to move the printing head to a required position outside the nonprinting area, thus substantially reducing efficiency in the printing operation.

In the explanation given with reference to FIG. 5, the example is used, in which the relationship between the driving voltage and bubble forming starting time in each of the two types is lined up along a substantially straight line. It is nonetheless possible to set values that do not form a straight line in each individual head construction. The point may be summarized as follows. Namely, the driving method of electrothermal energy converting element is broadly classified into two types. In one, the driving pulse is applied with a low voltage and a long bubble forming starting time. In the other, the driving pulse is applied with a relatively short pulse width and a sufficiently high voltage for realizing a proper ink discharge. The former driving method is executed during the period of the printing operation so as to oscillate ink at and around the discharge ports.

The ink jet printing apparatus according to the preferred embodiments of the present invention for realizing the aforementioned printing method will be described in detail.

(Overall Construction Overview)

Figure 1:
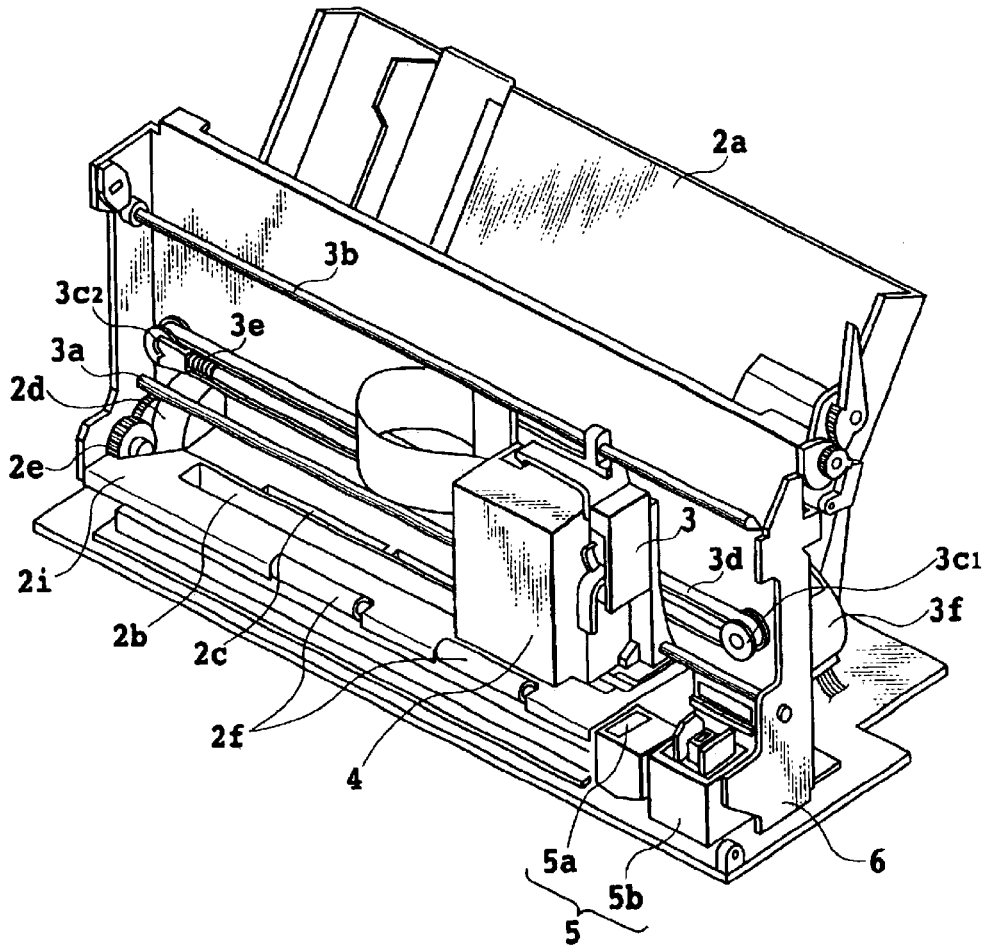
FIG. 1 is an explanatory perspective view showing a first embodiment of the ink jet printing apparatus.
Figure 2:
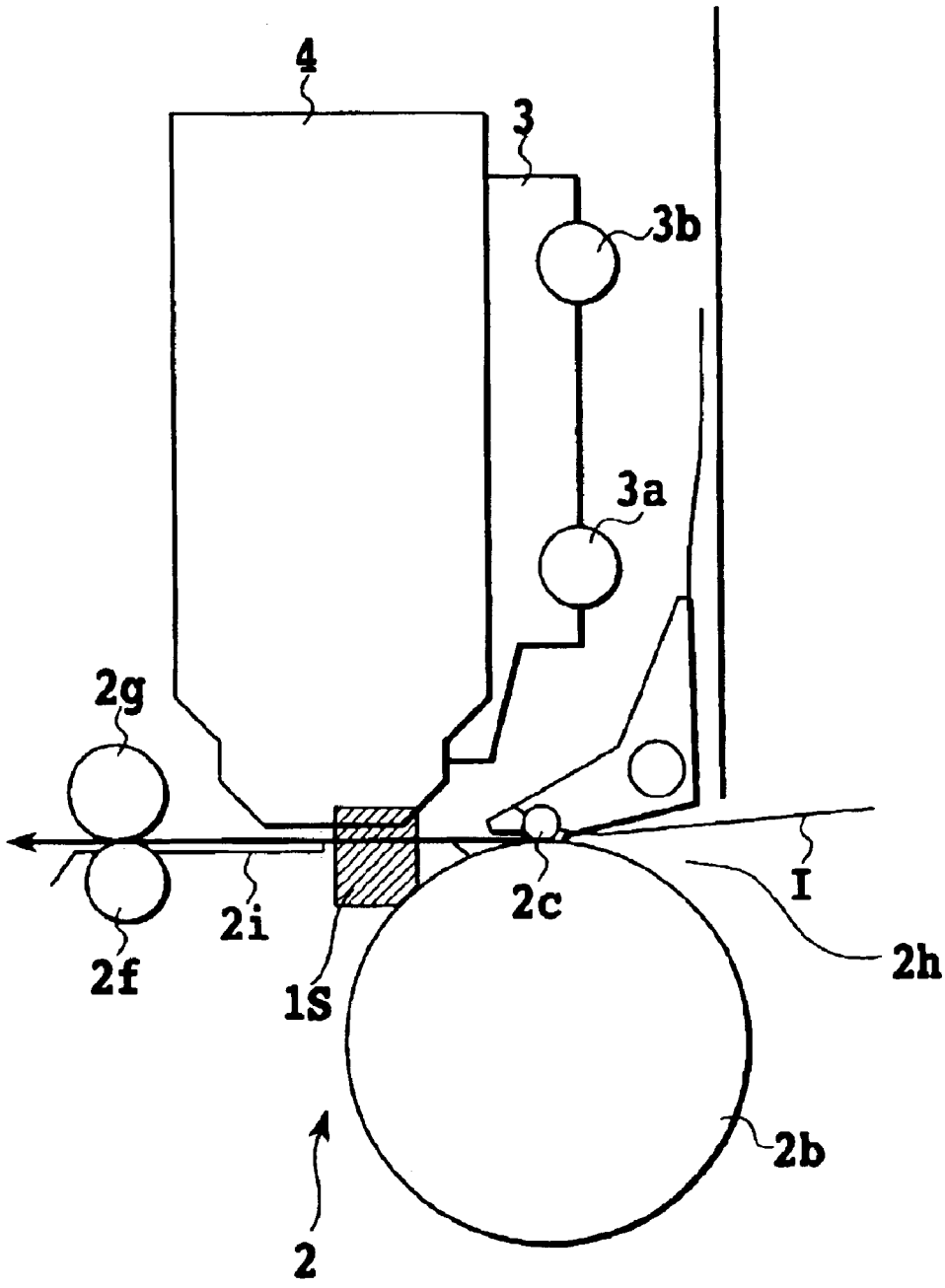
FIG. 2 is a longitudinal sectional side elevation view showing the first embodiment of the ink jet printing apparatus.

With reference to FIGS. 1 and 2, the overall construction of an ink jet printing apparatus according to a preferred embodiment of the present invention will be described. FIG. 1 is an explanatory perspective view showing the ink jet printing apparatus according to the preferred embodiment of the present invention and FIG. 2 is a longitudinal sectional side elevation view showing the same.

The ink jet printing apparatus according to the preferred embodiment of the present invention is constructed as follows. Specifically, transport means 2 transports a printing medium (paper, cloth, OHP transparencies, or the like) 1; a printing head 4 makes a reciprocating motion with a carriage 3 in a main scanning direction in relation to the printing medium 1; ink droplets are discharged from the printing head in accordance with an image signal to accomplish printing; and the printing medium 1, on which image is printed, is fed out onto a predetermined exit portion. After a printing operation, a recovery mechanism 5 performs a recovery operation for the printing head 4.

Each of the components mentioned earlier will be described in detail.

(Transport Means)

The transport means 2 transports the printing medium 1 to a printing position 1S and carrying out the printing medium 1 after having subjected to printing to the exit portion. The ink jet printing apparatus according to the preferred embodiment of the present invention permits either of the two different types of feeding of the printing medium. The two types of feeding are automatic feeding of the printing medium by means of an ASF (an auto sheet feeder) and manual feeding of the printing medium. In ASF feeding, a plurality of printing media 1 can be loaded in a stacked condition in an ASF 2*a* mounted on a printing apparatus main body 6. The printing medium 1 is nipped by a transport roller 2*b* and a pinch roller 2*c* that is in tight contact with, and driven by, the transport roller 2*b*. The transport roller 2*b* is driven and rotated so as to apply a transport force. A driving force of a transport motor 2*d* is transmitted to the transport roller 2*b* by way of a gear train 2*e* and the like. The printing medium 1 after having subjected to printing is fed out onto the exit portion by an exit roller 2*f* and a roll 2*g* that is in tight contact with, and driven by, the exit roller 2*f*.

In manual feeding, on the other hand, the printing medium fed in one sheet at a time through a manual feeding port 2*h* is transported linearly by drive provided by the transport roller 2*b* and the exit roller 2*f*. A platen 2*i* that serves as a supporting member for supporting the printing medium 1 from a backside thereof is provided at the printing position determined by the printing head 4 and on a downstream side from the printing position in a transport direction of the printing medium.

(Carriage)

A carriage 3 is a mechanism for making the printing head 4 make a reciprocating motion. Two guide shafts 3*a*, 3*b* are installed in an orthogonal direction in relation to the transport direction of the printing medium 1. The carriage 3 is slidably mounted on the guide shafts 3*a*, 3*b*.

A drive pulley 3*c*1 and a driven pulley 3*c*2 are mounted at positions near both ends of the guide shaft 3*a*. A timing belt 3*d* locked in the carriage 3 is wound around both pulleys 3*c*1, 3*c*2 and given a tension by a tension spring 3*e*. A carriage motor 3*f* is connected to the drive pulley 3*c*1. As the carriage motor 3*f* turns forward or backward, the carriage 3 makes a reciprocating motion along the guide shafts 3*a*, 3*b*.

(Printing Head)

The printing head 4 discharges ink to, and prints an image on, the printing medium 1 transported by transport means 2. The ink jet printing apparatus according to the preferred embodiment of the present invention uses an ink jet printing method accomplishing printing by discharging ink droplets. Specifically, the printing head 4 is provided with a fine ink discharge port (nozzle), a fluid passageway, an energy acting portion provided at part of the fluid passageway, and an electrothermal energy converting element constituted by electric resistance and serving as energy generating means for generating an ink droplet forming energy acting on ink resident in the energy acting portion.

(Recovery Mechanism)

A recovery mechanism 5 prevents the printing head 4 from being plugged up or developing a similar problem after printing. According to the preferred embodiment of the present invention, the recovery mechanism 5 is provided with a predischarge receiver 5*a* and a recovery system 5*b*. The predischarge receiver 5*a* receives ink discharged from the ink discharge ports of the printing head 4 when predischarge control is provided. The recovery system 5*b* is a capping mechanism for preventing the printing head 4 from developing an ink discharge failure. This capping mechanism is provided with a cap made of an elastic rubber or the like. This cap is connected with the ink discharge ports of the printing head 4 compressibly, thereby preventing water content from evaporating from the ink discharge ports. In addition, the recovery system 5*b* is further provided with a mechanism, with which a negative pressure is produced in the cap using a pump or the like after capping, thereby sucking and discharging thickened ink present at and around the ink discharge ports so as to maintain the ink condition at the discharge ports good for discharge.

The printing operation and the control performed for oscillating ink inside the nozzles of the ink jet printing apparatus according to the preferred embodiment of the present invention will be described.

When printing is effected on an entire surface of an area, in which printing can be actually effected on the printing medium 1 (printing enabled area e), as indicated by "A . . . A" in FIG. 3, the carriage 3 starts to run up from a run-up start position P1 to make a reciprocating motion on receipt of a printing start command. The printing head 4 mounted in the carriage 3 discharges ink droplets to effect printing according to a printing signal. At this time, the carriage 3 makes reciprocating motions as indicated by a line L in FIG. 3.

The control performed for oscillating ink inside the nozzles (hereinafter the "ink oscillating control") will be explained.

With a nozzle having a low use frequency in the printing head 4 provided with a number of nozzles, viscosity of ink tends to increase due to evaporation of water content in ink from the discharge ports or ink compositions may clog together on an ink surface to form a thin-film ink structure at and around the discharge ports of the nozzle. In such cases, a reduced discharge velocity of ink droplets could result at the discharge ports of the printing head, or plugged up discharge ports or other problems could occur.

To prevent these problems, measurements are taken of a discharge stop time during the printing operation, a nonuse rate of a nozzle, and the like. When the discharge stop time and the nonuse rate exceed predetermined values, the ink oscillating control for oscillating ink inside the nozzles is performed, thereby preventing the ink discharge velocity from dropping, discharge direction from being disordered, and non-discharge from occurring. This ink oscillating control is performed between the run-up start position P1 and a printing start position P2 of the carriage 3.

Figure 9:
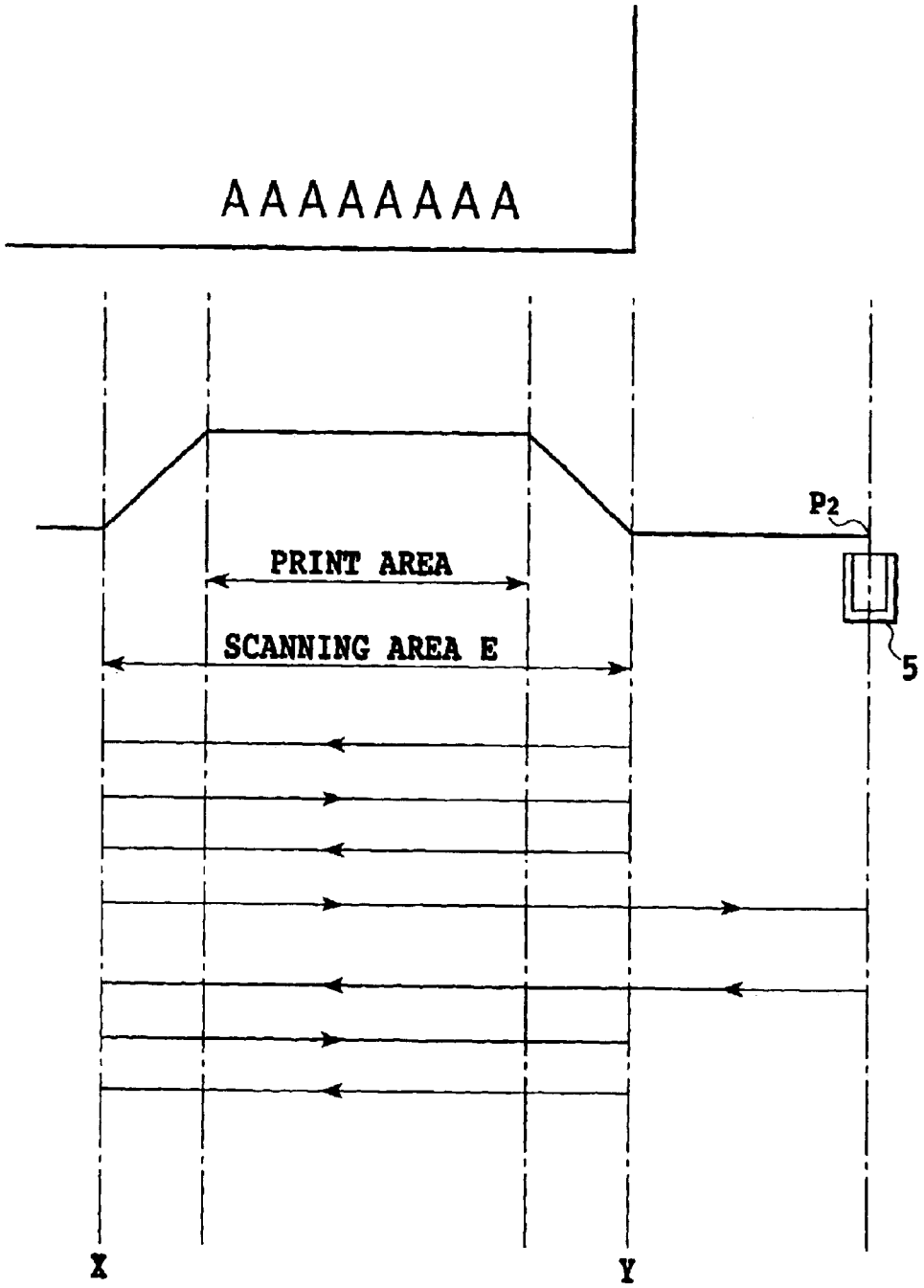
FIG. 9 is an explanatory diagram showing printing operation of an ink jet printing apparatus.

In the ink jet printing apparatus according to the preferred embodiment of the present invention, therefore, it is no longer necessary to move the carriage to a position beyond the ordinary scanning area E, as shown in FIG. 9. This contributes to a substantially improved overall printing speed.

A control system executing the aforementioned control operation will be described with reference to FIG. 6.

The control system employed in the preferred embodiment of the present invention uses a block driving method adopted by most of the currently available on-demand type ink jet printing apparatuses.

Instead of simultaneously driving a large number of nozzles provided in the printing head 4, this block driving method divides heating elements into groups and drives one group at one time in order to reduce load on the power source.

Figure 6:
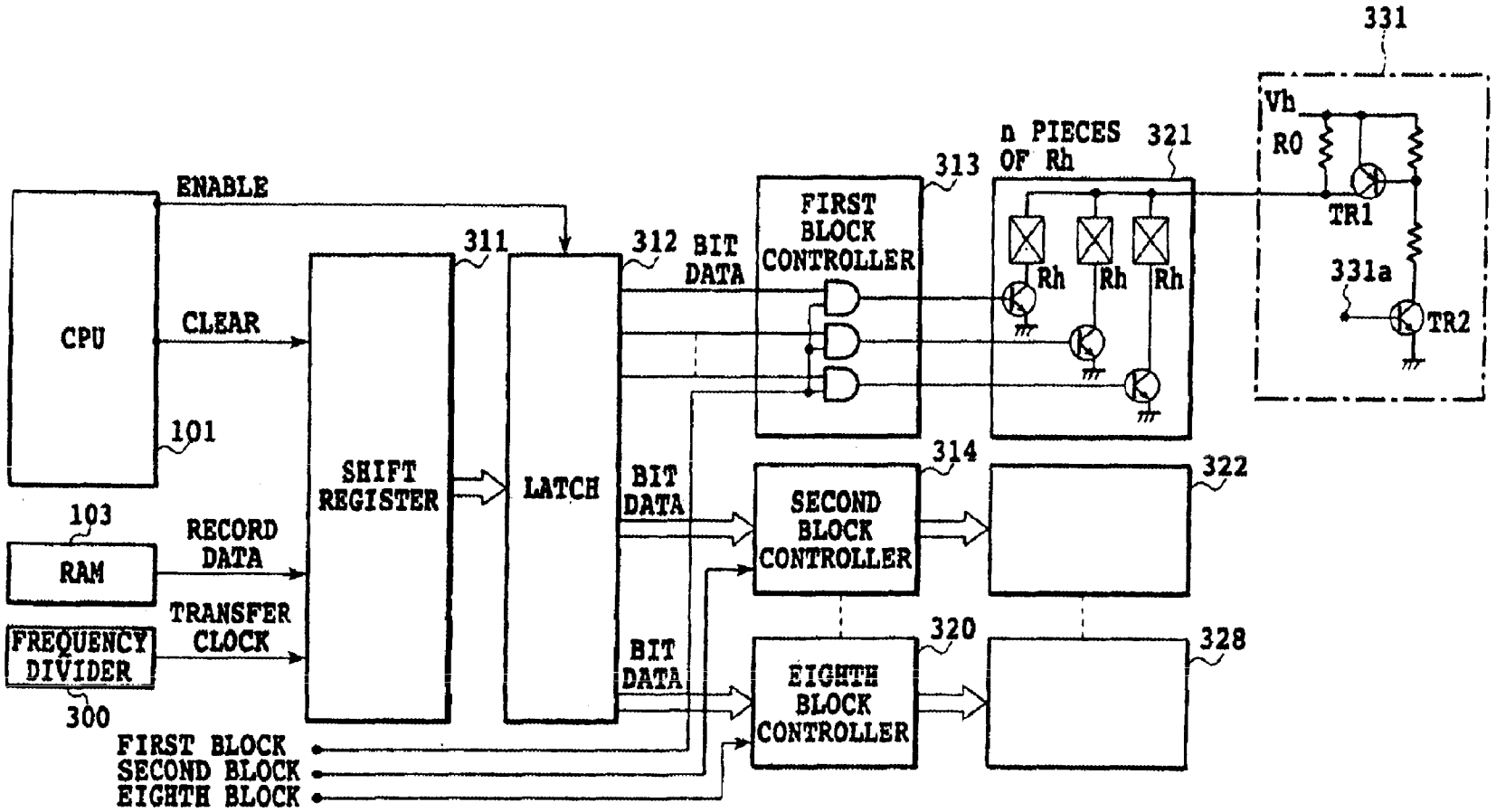
FIG. 6 is a block diagram showing a schematic configuration of the control system in the first embodiment of the ink jet printing apparatus.

In the example shown in FIG. 6, all nozzles of the printing head 4 are divided into eight blocks, which reduces a current capacity of the power source to ⅛.

Specifically, a first through an eighth block controller 313 to 320 are provided for controlling drive of heaters (electrothermal energy converting elements) Rh provided in the nozzles for each of the eight blocks of the printing head 4. Printing data from a latch 312 is transferred, and a block driving signal is applied, to these eight block controllers 313 through 320. The block driving signal determines a driving timing and a driving duration (pulse width) for each of the blocks, one being output from a CPU 101 to each block with a predetermined time lag from each other. This means that the number of nozzles that can be driven at once is ⅛ of the total number of nozzles provided in the printing head 4.

Further, each of the block controllers 313 to 320 generates a final bit driving signal for driving the heater Rh (electrothermal energy converting element) by taking a logical product of the data provided by the latch 312 and the block driving signal. The bit driving signal is supplied to each transistor TR of each of driving circuits 321 to 328. This turns ON or OFF the corresponding transistor TR. When the transistor TR is turned ON, the voltage supplied from a power supply circuit 331 is applied to the heater Rh and a resultant current flowing through the heater Rh generates a Joule heat. This heat produces bubbles in ink in the nozzles and energy (pressure) generated by the bubbles acts to discharge ink from the nozzle discharge ports.

In the ink jet printing apparatus according to the preferred embodiment of the present invention that adopts the block driving method as described in the foregoing, power consumption in driving the printing head can be reduced to ⅛, since each block is enabled for driving at different timings.

Further, in the ink jet printing apparatus according to the preferred embodiment of the present invention, only for a nozzle having a low use frequency, ink in that particular nozzle is oscillated only to the extent that the ink is not discharged from the discharge ports of the nozzle in question. Through this oscillation, the ink structure formed at and around the discharge ports can be destroyed and it is possible to maintain a proper ink discharge condition for all nozzles.

Figure 3:
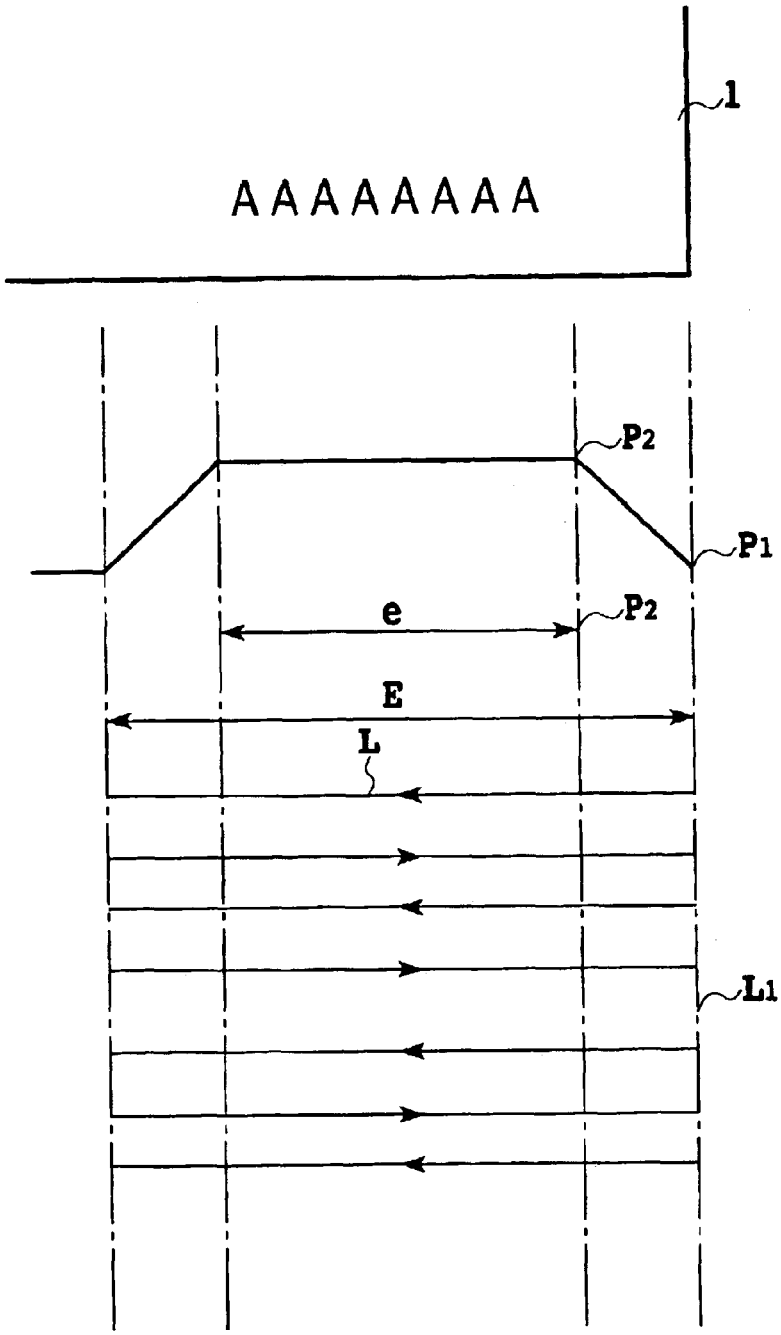
FIG. 3 is an explanatory diagram showing printing operation and oscillation control in the first embodiment of the ink jet printing apparatus.

This ink oscillating operation is carried out during a run-up period (from P2 to P1) that represents a non-printing area in the scanning range of the carriage 3 for the printing operation as shown in FIG. 3. At the same time, the driving voltage for carrying out the ink oscillating operation is made lower than that applied for carrying out an ordinary printing operation. In addition, the width of a pulse signal for setting the period of time, through which the driving voltage is supplied, is set so as to make the period of time longer than the bubble forming starting time. This is accomplished as follows. Specifically, data concerning the nozzle requiring the oscillating operation is transmitted to a shift register 311 and latched, and then the block driving signal having the pulse width as determined based on the results of the driving voltage-to-bubble forming starting time characteristics shown in FIG. 5 is input.

In the ink jet printing apparatus according to the preferred embodiment of the present invention, a driving voltage, with which ink droplets are not discharged from the nozzle, is selected in the range of type 2 (see FIG. 5) containing therein the lowest driving voltage and that driving voltage is set as the driving pulse voltage for oscillating ink. The pulse width of the driving pulse is set so as to result in a longer time than a bubble forming starting time that corresponds to the set driving voltage. When bubble forming starts, however, a space is produced between the heater and ink due to bubbles. This makes the ink substantially insulated from heat and it is thus meaningless to apply a driving pulse having an excessively long pulse width. Not to mention, there is no meaning in applying a driving pulse if the time falls short of the bubble forming starting time. It is therefore necessary to adequately adjust the pulse width based on the bubble forming times shown in FIG. 5.

In the ink jet printing apparatus according to the preferred embodiment of the present invention, a control unit for controlling electrical energy supplied from the driving power source is configured by a voltage supply circuit 331 as shown in FIG. 6. This configuration allows either of a high and a low voltage corresponding, respectively, to a time during the printing operation and that during non-printing operation to be selectively supplied to the heater Rh.

Specifically, in the ink jet printing apparatus according to the preferred embodiment of the present invention, the voltage supply circuit (voltage generating means) 331 selectively generates a power source voltage Vh and a voltage lower than the power source voltage.

The voltage supply circuit 331 is provided with transistors TR1, TR2. A resistor (voltage dropping means) R0 is connected across an emitter and a collector of the transistor TR1. The voltage supply circuit 331, the first to the eighth block controllers 313 to 320, and the driving circuits 321 to 328 form energization means for energizing the heater Rh.

In the energization means configured as described in the foregoing, when a base terminal 331*a* of the transistor TR2 of the voltage supply circuit 331 is set to a HIGH level, both transistors TR2 and TR1 turn ON and the power source voltage Vh is directly applied to the driving circuits 321 to 328. As a result, it becomes possible to supply relatively large electrical energy to the driving circuit heater Rh, allowing the nozzles to be driven in the range of type 1 shown in FIG. 5. That is, bubble forming suitable for discharging ink droplets can be realized, which, in turn, results in an image of good quality being formed.

When the base terminal 331*a* of the transistor TR2 is set to a LOW level, on the other hand, both transistors TR2 and TR3 turn OFF. Then, the resistor R0 is disposed in a circuit from the power source to the driving circuits 321 to 328. Because of this circuit configuration, a voltage lower than the power source voltage Vh can be supplied to the driving circuits 321 to 328 through a voltage drop occurring at the resistor R0. In this case, therefore, it is possible to drive each heater Rh in the range of type 2 shown in FIG. 5, meaning that bubbles can be produced in ink using relatively small electrical energy. In the ink jet printing apparatus according to the preferred embodiment of the present invention, therefore, ink can be oscillated while impeding ink droplets from being discharged from the nozzles. It is further possible, using this oscillation, to destroy the ink structure formed at and around the nozzle openings.

For nozzles having a low use frequency, therefore, ink can be maintained in a good condition at all times by performing driving of the type 2 without having to discharge ink.

[Second Embodiment]

An ink jet printing apparatus according to a second embodiment of the present invention will be described.

Figure 7:
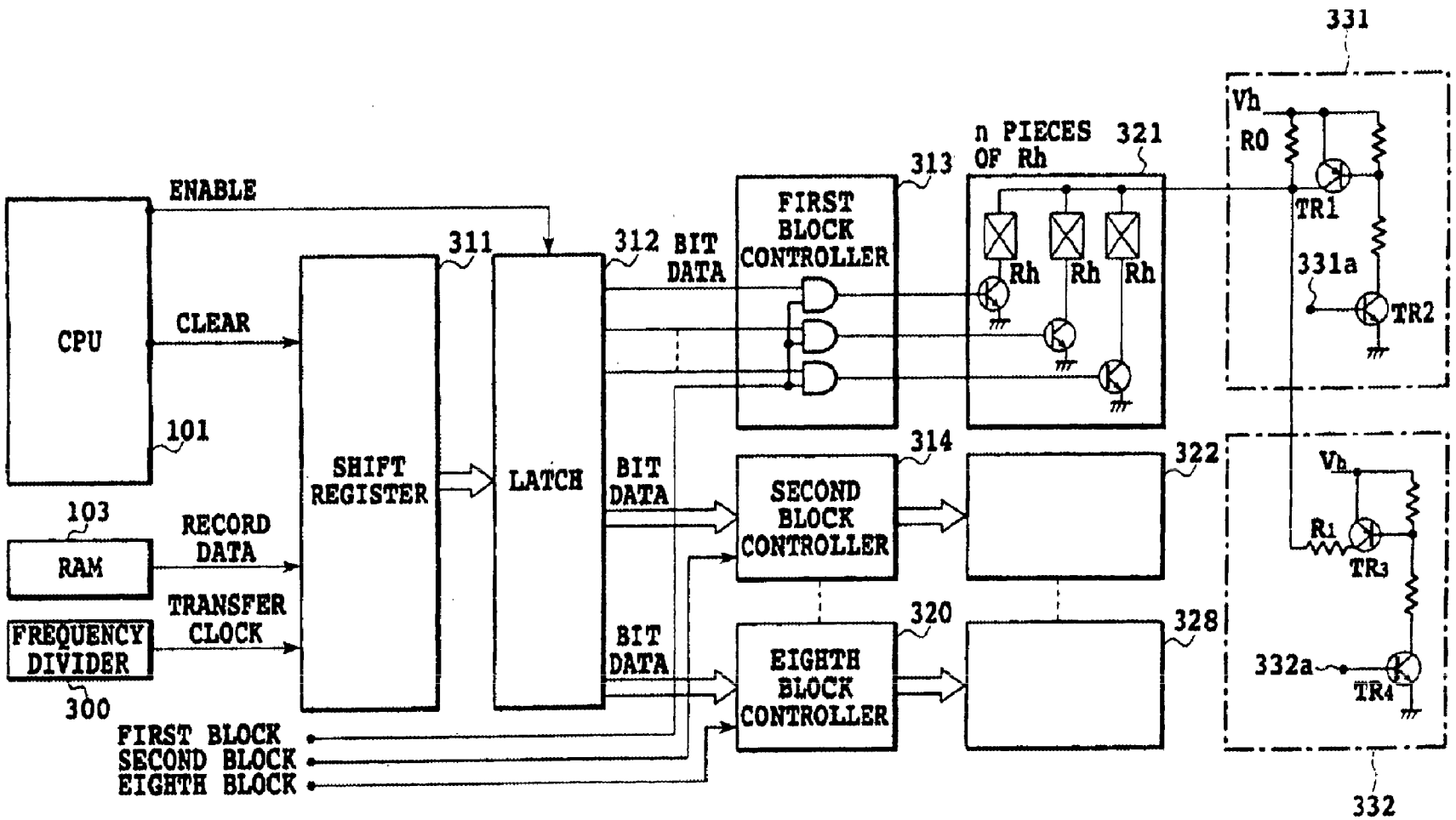
FIG. 7 is a block diagram showing a schematic configuration of the control system in a second embodiment of the ink jet printing apparatus.

The ink jet printing apparatus according to the second embodiment of the present invention is provided with a control system as shown in FIG. 7. The control system employed in the second embodiment represents the control system employed in the first embodiment, to which a second power supply circuit 332 is added. The control system employed in the second embodiment shares the same construction as the control system of the first embodiment for the rest.

Specifically, in the ink jet printing apparatus according to the second embodiment of the present invention, the control unit for controlling electrical energy supplied from a driving power source is configured with voltage generating means comprising the first voltage supply circuit 331 and the second voltage supply circuit 332. The first voltage supply circuit 331 is provided with the same components as those described for the first embodiment.

The second voltage supply circuit 332 is provided with transistors TR3, TR4, and the like. The emitter of the transistor TR3 is connected to the same power source as that for the first voltage supply circuit 331. The collector of the transistor TR3 is connected to one end of the resistor R0 through a resistor R1 (voltage dropping means) and to the collector of the transistor TR1.

In the control system configured as described in the foregoing, a base input terminal 332*a* is set to a LOW level during the ordinary printing operation, that is during driving through the type 1. Both the transistors TR4 and TR3 therefore turn OFF and the control system does not function as the power supply circuit for the heater Rh. Since a base input terminal 321*a* of the transistor TR2 is set to a HIGH level at this time, the power source voltage Vh is directly applied to the driving circuits 321 to 328 in the same manner as in the first embodiment.

When driving the heater for simply destroying the ink structure without involving any ink discharge, or driving is performed through type 2, the base terminal 332*a* of the transistor TR4 is set to a HIGH level. This turns ON the transistor TR4, which, in turn, turns ON the transistor TR3. In the first voltage supply circuit 331, both the transistors TR1 and TR2 turn OFF. As a result, both the resistors R0 and R1 become in parallel with respect to the power source Vh and a voltage after a voltage drop by these resistors, or a voltage lower than the power source voltage Vh, is applied to the driving circuit. Since the resistors R0 and R1 are mutually connected in parallel with the power source, however, the voltage drop produced herein is lower than the voltage drop produced through only the resistor R0. A voltage slightly higher than in the first embodiment is therefore applied to the driving circuits 321 to 328. For this reason, the second embodiment of the present invention is effective to an application, in which there are a large number of heaters Rh involved in forming bubbles simultaneously within a single block. For example, if a printing operation is resumed after a relatively long period of time, during which the particular printing apparatus has been left to stand idle, it is necessary to drive a large number of or all nozzles in the type 2. If, in this case, there are involved a large number of nozzles to be driven simultaneously, there can at times be a drop in the voltage applied to the driving circuits. The ink jet printing apparatus according to the second embodiment of the present invention, therefore, uses the second voltage supply circuit, as touched up earlier, to boost the voltage applied to the driving circuits in advance. This makes up a voltage drop resulting from the use of a greater number of heaters Rh involved, thus allowing bubble forming to properly and positively destroy the ink structure.

[Third Embodiment]

An ink jet printing apparatus according to a third embodiment of the present invention will be described.

Figure 8:
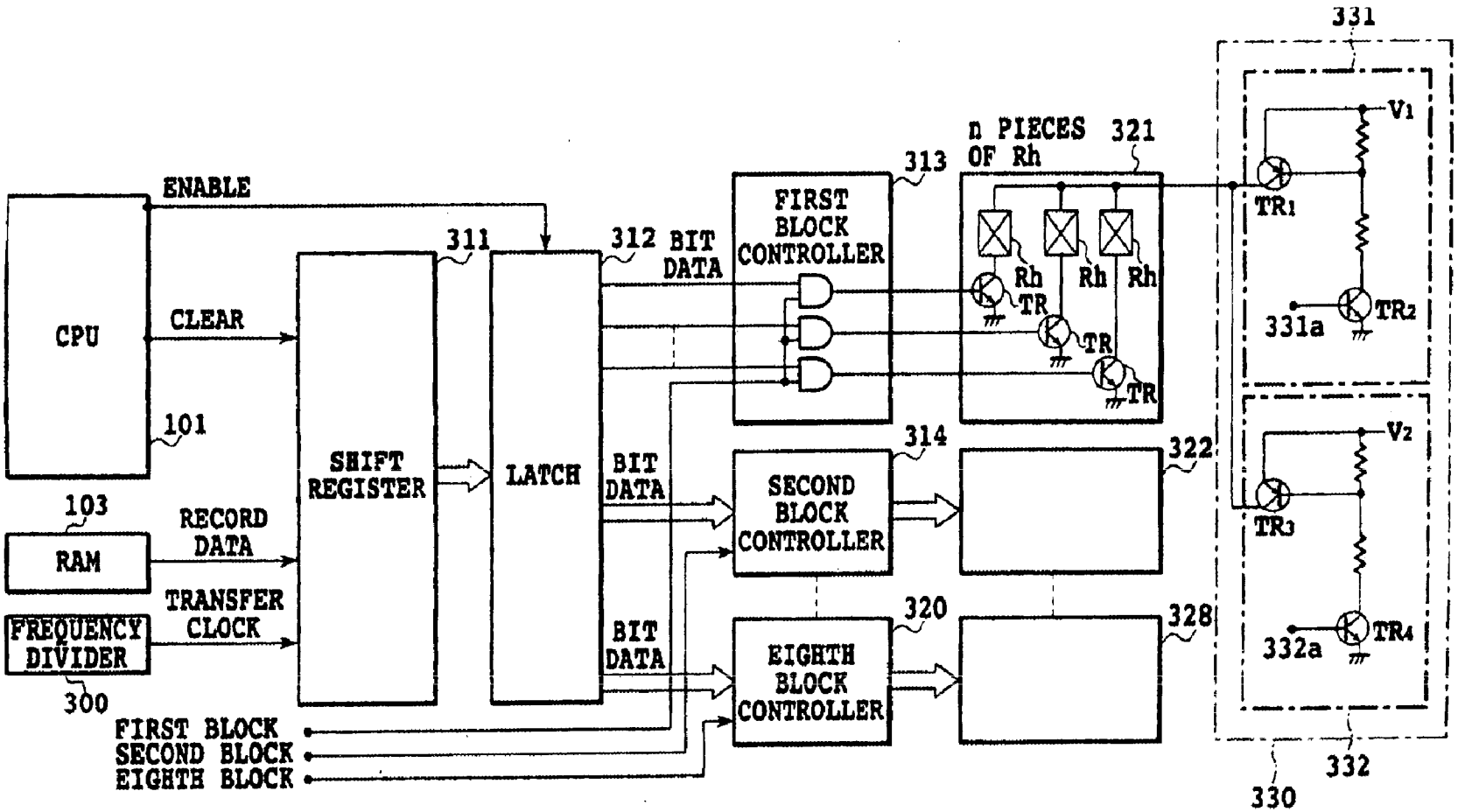
FIG. 8 is a block diagram showing a schematic configuration of the control system in a third embodiment of the ink jet printing apparatus.

The ink jet printing apparatus according to the third embodiment of the present invention is provided with a control system as shown in FIG. 8.

The control system employed in the ink jet printing apparatus according to the third embodiment of the present invention is provided with a power source circuit 330 having a configuration as shown in FIG. 8. This configuration allows either of a high and a low voltage corresponding, respectively, to a time during the printing operation and that during non-printing operation to be selectively supplied to the heater Rh.

Specifically, in the ink jet printing apparatus according to the third embodiment of the present invention, there are provided a first voltage supply circuit 331 supplying a relatively high power source voltage V1 and a second voltage supply circuit 332 supplying a relatively low power source voltage V2. The first voltage supply circuit 331 is provided with transistors TR1, TR2 and the like. The second voltage supply circuit 331 is provided with transistors TR3, TR4. In addition, energization means for the heater Rh is composed of the power source circuit 330, the first to the eighth block controllers 313 to 320, and the driving circuits 321 to 328.

In the energization means as configured as described in the foregoing, when the printing head exists in a printing operation area E, a base terminal 331*a* of the transistor TR2 in the first voltage supply circuit 331 is held in a HIGH level and the transistor TR2 is ON. The transistor TR1 is therefore ON, allowing the relatively high power source voltage V1 to be applied to the driving circuits 321 to 328.

In the second voltage supply circuit 332, on the other hand, a driving pulse inverted from a driving pulse applied to the base terminal 331*a* is applied to a base terminal 332*a* of the transistor TR4. That is, when the base terminal 331*a* of the first voltage supply circuit 331 is a HIGH level, the base terminal 332*a* of the second voltage supply circuit 332 is a LOW level. When the relatively high power source voltage V1 is being applied from the first voltage supply circuit 331, therefore, the transistor TR4 of the second voltage supply circuit 332 is OFF and the transistor TR3 is also OFF. Thus, the relatively low power source voltage V2 is not applied to the driving circuits 321 to 328.

When the relatively high power source voltage V1 from the first voltage supply circuit 331 is shut down, the transistor TR4 of the second voltage supply circuit 332 is ON and the transistor TR3 is also ON. The relatively low power source voltage V2 is therefore applied to the driving circuits 321 to 328. In the manner as described in the foregoing, the voltage supply circuit 331 or 332 is selectively selected to select either the relatively high power source voltage V1 or the relatively low power source voltage V2 as appropriately as the voltage applied to the driving circuits 321 to 328. When the relatively low power source voltage V2 is supplied, a driving pulse having a pulse width longer than the application time of the relatively high power source voltage V1 for discharging ink from the nozzles is applied. This allows bubbles to be formed in the ink, while suppressing discharge of ink. In addition, it is possible to oscillate ink with the energy produced through bubble forming to destroy the ink structure formed at and around the nozzle discharge ports, thus maintaining the ink in a condition suitable for discharge.

Figure 4:
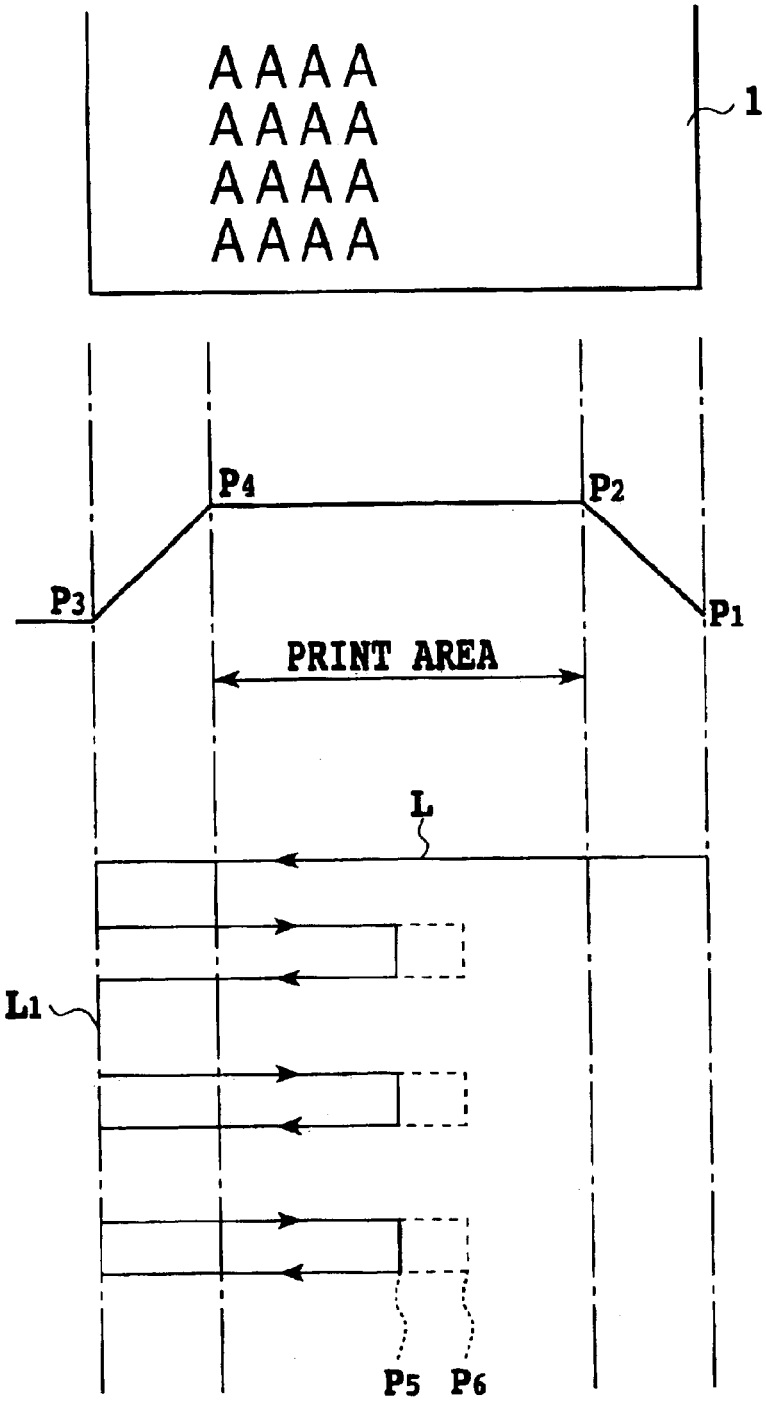
FIG. 4 is an explanatory diagram showing another example of printing operation and oscillation control in the first embodiment of the ink jet printing apparatus.

In each of the preferred embodiments described in the foregoing, the ink oscillating control is executed only during the run-up period on one side (from P2 to P1) in the scanning period of the carriage 3. It is nonetheless to be understood that the invention is not limited to only these embodiments. Rather, as shown by another embodiment shown in FIG. 4, it is possible to execute the ink oscillating control during the run-up period on the other side (from P3 to P4). Through this arrangement, the printing operation is executed only on one side of the printing medium 1 as indicated, for example, by "AAAA-" in FIG. 4. If the carriage 3 does not travel to the run-up period on one side (from P1 to P2) as shown by the line, it is possible to perform the oscillating control for the run-up period on the other side (from P5 to P6), thus shortening the printing time.

Furthermore, it is still possible to perform the oscillating control in the run-up periods of both sides (from P1 to P2, and from P3 to P4) of the printing area E.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink jet printing apparatus capable of mounting a printing head having a plurality of ink discharging ports for discharging ink, electrothermal energy converting elements provided corresponding to each of said plurality of ink discharging ports, said electrothermal energy converting elements capable of being energized by an energization means and then generating a bubble in the ink to discharge ink; said energization means comprising:

a single driving power source serving as a source of supplying an electrical energy; and a control unit for controlling the electrical energy supplied from said driving power source;

wherein said control unit performs a control for supplying said electrothermal energy converting elements with said electrical energy that generates said bubble to the extent that ink droplets are discharged from the ink discharge ports, if the electrothermal energy converting elements are driven to accomplish printing;

wherein said control unit performs a control for supplying said electrothermal energy converting elements with said electrical energy that generates said bubble to the extent that ink droplets are not discharged from the ink discharge ports;

wherein said controls are selectively performed; and wherein said control unit has voltage generating means for generating at least two types of voltage such as a high voltage and a low voltage, the voltage generating means applying a relatively low voltage to said electrothermal energy converting elements when generating said bubble to the extent that ink droplets are not discharged from the ink discharging ports.

2. The ink jet printing apparatus according to claim 1, wherein said voltage generating means is provided with a voltage drop generating means for generating at least one type of voltage lower than the voltage supplied by the driving power source and either the voltage supplied by said driving power source or the voltage obtained through said voltage drop generating means is selectively supplied to driving means for supplying or shutting down voltage supply for said electrothermal energy converting elements.

3. The ink jet printing apparatus according to either one of claims 1 and 2, wherein said control unit is provided with an energization time control means for selecting either a long period of time or a short period of time, during which the voltage generated by said voltage generating means is applied, and said energization time control means sets an energization time valid when a lower voltage of the high and low voltages generated by said voltage generating means is selected longer than the energization time valid when the higher voltage is selected.

4. The ink jet printing apparatus according to claim 3, wherein the energization time set when the low voltage is provided by said voltage generating means is established through selection from among bubble forming times available in a type having the lowest applied voltage out of two types approximated with two substantially straight lines and a type resident in a boundary area of these two types when an applied voltage-to-bubble forming starting time characteristics of said electrothermal energy converting elements are plotted on a double logarithmic chart.

5. An ink jet printing method using a printing head having a plurality of ink discharging ports for discharging ink, electrothermal energy converting elements provided corresponding to each of said plurality of ink discharging ports, said electrothermal energy converting elements being capable of being energized by an energization means and then generating a bubble in the ink to discharge ink; comprising the steps of:

supplying said electrothermal energy converting elements with an electrical energy that generates said bubble to the extent that ink droplets are discharged from the ink discharge ports, if the electrothermal energy converting elements are driven to accomplish printing; and supplying said electrothermal energy converting elements with an electrical energy that generates bubbles to the extent that ink droplets are not discharged from the ink discharge ports;

wherein the steps are selectively performed; and wherein said steps are accomplished using a voltage generating means for generating at least two types of voltage such as a high voltage and a low voltage, the voltage generating means applying a relatively low voltage to said electrothermal energy converting elements when generating said bubble to the extent that ink droplets are not discharged from the ink discharging ports.

6. An ink jet printing apparatus capable of mounting a printing head having a plurality of ink discharging ports for discharging ink, electrothermal energy converting elements provided corresponding to each of said plurality of ink discharging ports, said electrothermal energy converting elements capable of being energized by an energization means and then generating a bubble in the ink to discharge ink;

wherein said energization means generates driving signals for supplying said electrothermal energy converting elements corresponding to low use frequency ink discharging ports with such an electrical energy that generates bubbles in ink in said low use frequency ink discharging ports to the extent that ink droplets are not discharged from said low use frequency ink discharging ports; and wherein said energization means is provided with a voltage generating means for generating at least a high voltage and a low voltage and voltage selecting means capable of applying selectively either of the two different voltages generated by said voltage generating means to said electrothermal energy converting elements.

7. The ink jet printing apparatus according to claim 6, wherein said energization means is provided with an energization time control means for selecting either a long period of time or a short period of time, during which the voltage generated by said voltage generating means is applied, and said energization time control means sets an energization time valid when a lower voltage of the high and low voltages generated by said voltage generating means is selected longer than the energization time valid when the higher voltage is selected.

8. The ink jet printing apparatus according to claim 7, wherein the energization time, set when the lower voltage of the high and low voltages generated by said voltage generating means is selected, is established through selection from among bubble forming times available in a type having the lowest applied voltage out of two types approximated with two substantially straight lines and a type resident in a boundary area of these two types when an applied voltage-to-bubble forming starting time characteristics of said electrothermal energy converting elements are plotted on a double logarithmic chart.

9. An ink jet printing method using a printing head having a plurality of ink discharging ports for discharging ink, electrothermal energy converting elements provided corresponding to each of said plurality of ink discharging ports, said electrothermal energy converting elements capable of being energized by an energization means and then generating a bubble in the ink to discharge ink; said method comprising the step of:

generating driving signals with said energization means for supplying said electrothermal energy converting elements corresponding to low use frequency ink discharging ports with such an electrical energy that generates bubbles in ink in said low use frequency ink discharging ports to the extent that ink droplets are not discharged from said low use frequency ink discharging ports; and energizing said electrothermal energy converting elements with at least either a high voltage or a low voltage applied selectively thereto.

10. The ink jet printing method according to claim 9, wherein an energization time set when, of the high and the low voltages applied to said electrothermal energy converting elements, the low voltage is selected is longer than an energization time set when the high voltage is selected.

11. The ink jet printing method according to claim 10, wherein the energization time, set when the lower voltage of the high and low voltages generated by said voltage generating means is selected, is established through selection from among bubble forming starting times available in a type having the lowest applied voltage out of two types approximated with two substantially straight lines and a type resident in a boundary area of these two types when an applied voltage-to-bubble forming starting time characteristics of said electrothermal energy converting elements are plotted on a double logarithmic chart.

* * * * *